US005660896A

United States Patent [19]

Normand et al.

[11] Patent Number: 5,660,896

[45] Date of Patent: Aug. 26, 1997

[54] IDENTIFICATION CARD AND CARRIER

[75] Inventors: Roger J. Normand, Byron; Eugene C. Fogle, Sycamore, both of Ill.

[73] Assignee: The Reynolds and Reynolds Company, Dayton, Ohio

[21] Appl. No.: 442,949

[22] Filed: May 17, 1995

[51] Int. Cl.[6] ..... G09F 3/00

[52] U.S. Cl. ..... 428/13; 428/43; 428/187

[58] Field of Search ..... 428/13, 43, 187

[56] References Cited

U.S. PATENT DOCUMENTS

| | | | |
|---|---|---|---|
| 4,664,982 | 5/1987 | Genovese et al. | 428/447 |
| 5,049,443 | 9/1991 | Kuszaj et al. | 428/332 |
| 5,219,183 | 6/1993 | McKillip | 428/43 X |

*Primary Examiner*—Henry F. Epstein

*Attorney, Agent, or Firm*—Dorn, McEachran, Jambor & Keating

[57] ABSTRACT

A temporary identification card having smooth edges is formed from a carrier of continuous form stock having indicia printed on its upper and/or lower surfaces. A retainer patch adheres to the bottom surface of the carrier by means of an adhesive area. The retainer patch has first and second plastic layers chemically bonded to one another. The card is die cut all the way around its perimeter, the die cutting extending through the form stock, the adhesive and the first layer of the retainer patch but not the second layer. The bond between the first and second layers of the retainer patch allows the second layer to retain the card in the carrier until such time as a user chooses to remove the card from the carrier.

6 Claims, 1 Drawing Sheet

IDENTIFICATION CARD AND CARRIER

BACKGROUND OF THE INVENTION

Temporary identification or membership cards are commonly used in industries such as travel, auto and health insurance and others to provide proof of insurance coverage, membership or the like. These cards are typically date-sensitive and expire at regular intervals so they are replaced often. Accordingly, it is not economical for the issuer to provide a permanent card. Instead temporary cards are used which have a useful life of about one year.

The cards usually have information printed thereon, including the user's name, the issuer's name, identifying codes, effective dates and the like. Usually the cards are attached to some kind of carrier sheet containing further information for the user. The carrier sheet and card are often sent through the mail. One area of the carrier sheet or card may include a mailing address. Printing the cards and preparing them for mailing in a high-speed, on-line process has proven to be a problem.

Current technology often involves use of cards which are made separately from the carrier sheet and then glued to the surface of the carrier sheet. Such cards are known as tipped-on cards. Tipping-on allows for a smooth edge to the card but requires two separate printing operations, one for the card and one for the carrier. It also requires that the cards be attached to the carrier in a separate tipping operation which is slow. The largest disadvantage to this design is that customer specific information cannot be non-impact printed on both the card and carrier without degradation of the print quality adjacent to the card. The tipped-on cards frequently come free from the carrier as they pass through the non-impact printers where they are subject to high heat, pressure and bending.

Cards made by perforating the carrier stock can overcome the limitations Just described but such cards are difficult to remove from the carrier stock without the risk of coming loose in the non-impact printers or being torn by the end user. Furthermore, the perforated cards leave little ties or protruding paper fibers where the carrier stock was not perforated, so the edges of the card are not smooth. Smooth edges and easy removal are highly desirable for these cards.

SUMMARY OF THE INVENTION

This invention relates to a temporary identification card and a method of making it. A primary object of the invention is a card having smooth edges with no perforations or ties.

Another object is a card which can be made flush with a carrier sheet.

A further object of the invention is a card which can be made with a carrier sheet which will permit the entire form, card and carrier, to pass reliably through non-impact type printers and laser type printers.

Still another object of the invention is a card of the type described which can be easily and cleanly separated from the carrier by the end user.

Another object of the invention is a card which leaves no exposed adhesive on the card or carrier sheet.

Yet another object of the invention is a card which can be produced in a high-speed, on-line operation.

A further object is a card which makes efficient use of the form stock and retainer materials, resulting in minimum lost material and minimum cost.

These and other objects which may appear in the following description are realized by a temporary identification card made from a carrier of form stock. User-specific information is printed on the upper or top side of the carrier and optionally covered by a layer of laminated clear film. An area of adhesive on the underside or bottom side of the carrier bonds a retainer patch to the underside of the carrier. The patch is formed of two layers of chemically-bonded plastic. The first layer is adjacent the adhesive with the second layer underneath. The card is formed by die-cutting through the carrier stock, the adhesive area and the first layer of the retainer patch. The second layer of the patch is not cut. The die-cutting is continuous all the way around the perimeter of the card; no ties are left. The bond between the first and second layers is strong enough to hold the card in the carrier but weak enough to allow the end user to peal the card easily out of the carrier and away from the second layer. The carrier may also include information that is retained by the user. The adhesive on the card will be covered by the first layer and the adhesive on the carrier will be covered by the retaining patch.

DETAILED DESCRIPTION OF THE INVENTION

Figure 1:
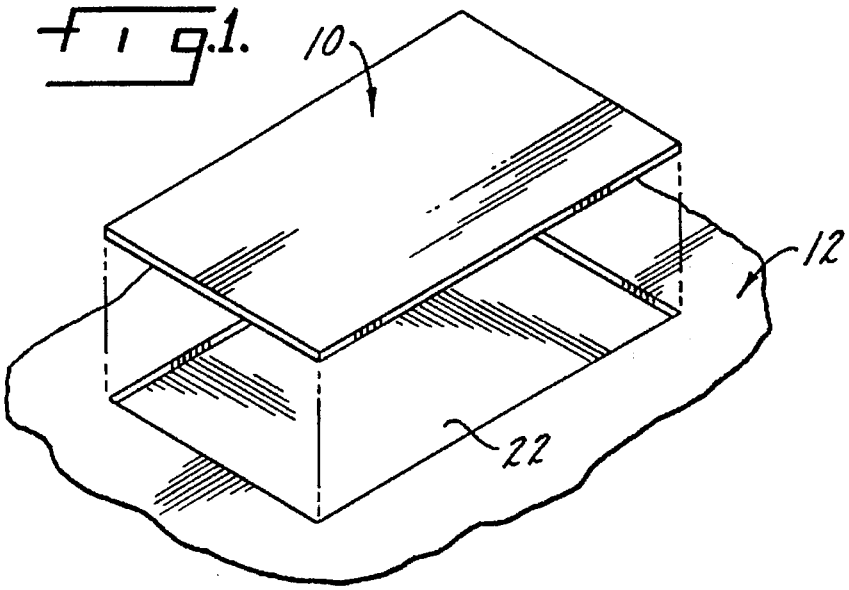
FIG. 1 is a perspective view of the temporary identification card removed from a carrier sheet.
Figure 2:
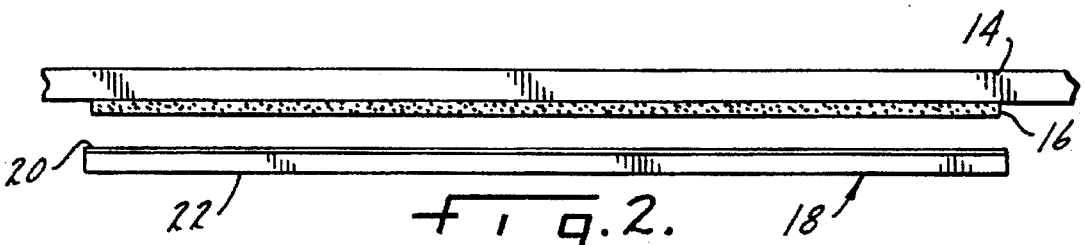
FIG. 2 is a side view of a carrier, adhesive area and retainer patch prior to applying the patch to the carrier.
Figure 3:
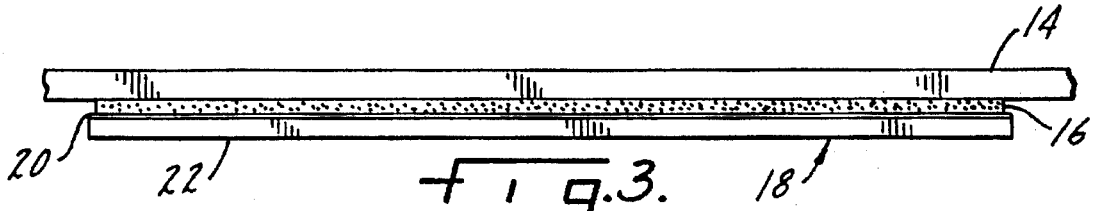
FIG. 3 is a side view of a carrier with a retainer patch adhered thereto.
Figure 4:
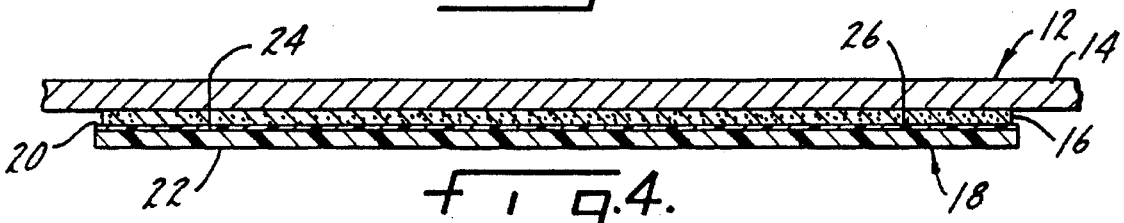
FIG. 4 is a side view of a carrier and retainer patch die cut to define a temporary identification card.
Figure 5:
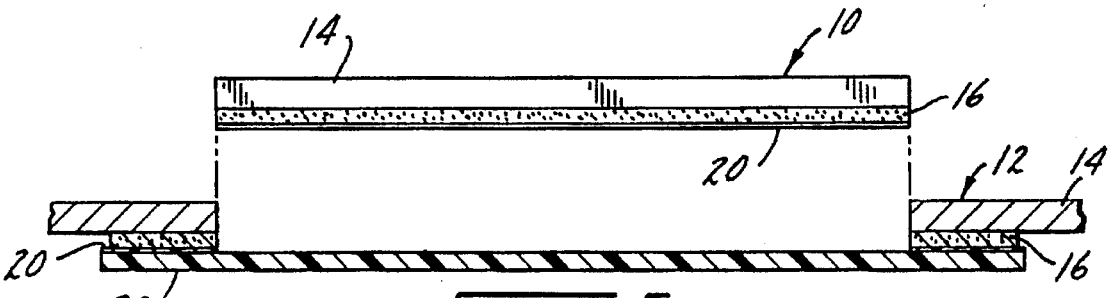
FIG. 5 is a view similar to FIG. 4 showing the card removed from the carrier.

FIGS. 1–5 illustrate the temporary identification card of the present invention and the steps for making it. A finished card 10 is shown in FIGS. 1 and 5 removed from a carrier sheet matrix 12. The carrier sheet originally is a continuous sheet 14 of a suitable form stock (FIG. 2). This could be either paper, card stock or plastic based. Although it is preferred that the form stock is continuous, cut sheets could also be used. Normally the carrier sheet is printed on one or both sides with whatever information is desired prior to the steps described below.

An area of adhesive 16 is applied to the underside of the carrier sheet 14 as shown in FIG. 2. This adhesive area covers that part of the carrier which will become the card and a portion outside the area of the card. The adhesive is preferably pressure-sensitive, either hot melt or acrylic.

A retainer patch shown generally at 18 is bonded to the underside of the carrier by the adhesive 16. The retainer patch has first and second layers 20 and 22 of plastic film which are chemically bonded to one another. The chemical bond is strong enough to hold the film layers together but weak enough that an end user can easily separate the two layers. The layers are transparent so any graphics applied to the underside of the carrier sheet are visible. A suitable retainer material is available from Technicote Inc. of Miamisburg, Ohio under their trademark Technimagic. Other suitable materials may also be available from other suppliers. The patch 18 is sized to extend somewhat beyond the edges of the adhesive area 16 so that no adhesive remains exposed after application of the patch. FIG. 3 illustrates this concept.

Once the retainer patch is in place, the perimeter of the card is die cut as shown by cut lines 24 and 26 in FIG. 4. The cut lines extend through the carrier sheet 14, adhesive 16 and the first layer 20 of the patch 18. The second layer 22 is not cut. Thus, the chemical bond between layers 20 and 22 retains the card 10 in the carrier sheet until such time as a user wishes to peal the card away from the second layer. The cut lines extends fully around the perimeter of the card without interruption or perforations so the card will have smooth edges. When the card is removed as shown in FIG. 5, the card will comprise a piece of the carrier sheet 14, a portion of adhesive 16 and a portion of the first layer 20. The entire second layer 22 remains with the carrier sheet matrix 12, as do portions of the adhesive 16 and first layer 20.

While a preferred form of the invention has been shown and described, it will be realized that alterations and modifications may be made thereto without departing from the scope of the following claims. For example, while the retainer is preferably applied in the form of a patch to minimize usage of this material, the retainer could also be applied as a continuous sheet to the underside of the carrier sheet. Also, the area of adhesive could be applied to the patch instead of to the underside of the carrier.

We claim:

1. A structure for an identification card comprising a carrier sheet, a retainer patch having first and second layers of film chemically bonded to one another, the retainer patch being attached to the underside of the carrier with the first film layer facing the carrier, and cut lines defining the boundaries of the card and extending fully around the perimeter of the card without interruption, the cut lines being located in the carrier at a point overlying the retainer patch and having a depth such that the cut lines extend through the carrier and first film layer but not through the second film layer, the chemical bond between the first and second film layers being sufficient to retain the card in the carrier until such time as a user chooses to remove the card from the carrier.

2. The structure of claim 1 wherein the retainer patch is bonded to the carrier by an area of adhesive.

3. The structure of claim 2 wherein the adhesive area extends beyond the edges of the card.

4. The structure of claim 2 wherein the retainer patch extends beyond the area of adhesive so that no adhesive is exposed.

5. The structure of claim 1 wherein the carrier is made of continuous form stock.

6. The structure of claim 1 further comprising a clear cover layer fixed to the top side of the carrier.

* * * * *